US006612560B2

(12) United States Patent
Sanders

(10) Patent No.: US 6,612,560 B2
(45) Date of Patent: Sep. 2, 2003

(54) MAGNETIC ALIGNER FOR FASTENED STACKS

(75) Inventor: Kenneth D. Sanders, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 191 days.

(21) Appl. No.: 09/725,383

(22) Filed: Nov. 29, 2000

(65) Prior Publication Data

US 2002/0063373 A1 May 30, 2002

(51) Int. Cl.[7] ..... B65H 39/00

(52) U.S. Cl. ..... 270/58.12; 270/58.08; 399/410; 414/788.9

(58) Field of Search ..... 271/207, 208, 271/209, 220, 221, 222, 223, 224; 270/58.08, 58.01, 58.12; 414/788.3, 788.9, 794.3; 399/410

(56) References Cited

U.S. PATENT DOCUMENTS 3,467,371 A 9/1969 Britt et al. ..... 270/58
4,369,015 A * 1/1983 Fabrig ..... 198/374
4,623,291 A * 11/1986 Buck ..... 414/788.3
4,961,092 A 10/1990 Rabb et al. ..... 355/323
5,026,034 A 6/1991 Russel et al. ..... 270/52
5,409,201 A * 4/1995 Kramer ..... 270/58.13
5,609,333 A 3/1997 Mandel et al. ..... 270/58.09
5,762,329 A 6/1998 Nakazato et al. ..... 270/58.09
5,842,624 A 12/1998 Ishida ..... 227/111
6,244,583 B1 * 6/2001 Ohmichi et al. ..... 270/58.07
6,328,299 B1 * 12/2001 Coombs ..... 270/58.08
6,382,614 B1 * 5/2002 Fukatsu et al. ..... 270/58.09
6,394,441 B1 * 5/2002 Cruz et al. ..... 270/37

* cited by examiner

*Primary Examiner*—Patrick Mackey
(74) *Attorney, Agent, or Firm*—Perman & Green, LLP

(57) ABSTRACT

A stacking apparatus and method. A document set stacking apparatus and method is provided for use in a document creating apparatus. A set stacking area is provided that has been adapted to accept a stack of a plurality of document sets having fasteners. A set relief area is provided for the portion of the document sets containing the fasteners. At least one fastener attractor is provided adjacent the set relief area. The fastener attractor attracts the fasteners and the portions of the document sets containing the fasteners toward the set relief area.

23 Claims, 6 Drawing Sheets

MAGNETIC ALIGNER FOR FASTENED STACKS

BACKGROUND OF THE INVENTION

1. Field of the Invention

This invention relates to copying machines and printing machines, and, more particularly to copying systems or printing systems with a document stacking apparatus and method.

2. Prior Art

Many different output sections for electrostatographic copying systems or printing systems are known in the art for stacked document sets having fasteners. For example, U.S. Pat. No. 5,609,333 discloses a sheet stacking height control system used in a sheet stacking apparatus for stacking plural sheets into at least one stacking tray. Another example, U.S. Pat. No. 5,026,034 discloses an apparatus for feeding and stacking sets of finished sheets in an electrostatographic copier or printer including an anti-dishevelment device for preventing the tearing, dishevelment and other damaging of the top sheet of the top set of the sets in the stack by contacting and holding down such top sheet during the feeding of a new set onto the top of the stack. Both of the above referenced patents are incorporated by reference in their entirety. Document output devices commonly stack fastened, stapled or otherwise finished sets of document sheets one at a time on top of others for later removal by an operator.

A common problem associated with the stacking of document sets is bin or tray under utilization due to stack height variations and the resultant tray or bin capacity variations. The actual and maximum stacking height in a tray or bin can vary considerably with different print job factors. For example, with variations in the sheet thickness, humidity, sheet curl, staples or other binding, edge climbing by sheet edges partially hanging up on vertical registration edges, and other factors affecting stack height. Additionally, maximum stack height may occur only in certain areas of the stack. This is demonstrated especially when fasteners or staples are used in the document set. Stacks of plural fastened or stapled sets tend to have a much higher height level where the fasteners or staples overlie or overlap on top of one another in the stack. Fastener or staple buildup is particularly pronounced for small sets of only a few sheets per stapled set. It has been found for example that a stack of multiple sets of only two sheets per stapled set, such as a common two page letter, can have a maximum stack height in the area of the stack where all those staples overlie one another of more than twice the stack height of other areas of that stack. Consequences of bin or tray under-utilization can include unnecessarily splitting up final print jobs for a user by redirecting them to another mailbox bin or an overflow tray when there was actually still enough stacking room or headspace in the first bin to finish stacking that job or jobs in the first bin. Increased bin or output tray capacity can help to better maximize bin and tray usage and availability when more sheet or document set stacking room is actually available in a given bin or tray. Increased bin or output tray capacity can help to increase productivity and maximizes utilization of the printer output and mailbox system by reducing printing stoppages of the reproduction apparatus, and/or reducing the required number of mailbox bins or output trays. There is a desire to provide a stacking apparatus that provides additional stack capacity to reduce bin or tray under utilization due to stack height variations and particularly stack height variations due to fastener or staple buildup.

Another common problem associated with the stacking of document sets is the tendency of the set being fed and stacked to tear or otherwise damage the top sheet of the top set of the sets already in the stack. This problem is further complicated by limitations with respect to which edge or corner of the document sheets are, for example, fastened, stapled or bound for forming the set. There is a desire to provide a stacking apparatus that provides a reduced tendency of the set being fed and stacked to be torn or otherwise damaged by the sets already in the stack or of the set being fed and stacked to tear or otherwise damage the top sheet of the top set of the sets already in the stack or to be torn or otherwise damaged by the sets already in the stack.

SUMMARY OF THE INVENTION

In accordance with one embodiment of the present invention, a document set stacking apparatus is provided for use in a document creating apparatus. A set stacking area is provided that has been adapted to accept a stack of document sets having fasteners. A set relief area is provided which a portion of at least one of the document sets containing the fasteners can be attracted toward by a fastener attractor. In one embodiment, the fastener attractor can be at least one magnet provided adjacent to the set relief area. The magnet attracts the fasteners and the portions of the document sets containing the fasteners toward and into the set relief area.

In accordance with another embodiment of the present invention, a document set stacking apparatus is provided for use in a document creating apparatus. A tray is provided onto which a plurality of document sets having fasteners can be placed. A magnetic device is provided adjacent to the tray and adapted to attract the fasteners. The fasteners are attracted to the magnetic device. As a result, the documents sets are, at least partially, retained in the stack when a new document set is fed on the stack.

In accordance with another embodiment of the present invention, a method of stacking one or more document sets having fasteners on a stacking surface is provided comprising a first step of placing at least one document set on the stacking surface. The fasteners and consequently the region of the set containing the fastener are attracted toward a relief area of the stacking surface by an attracting force.

BRIEF DESCRIPTION OF THE DRAWINGS

For a general understanding of the present invention, as well as other aspects thereof, reference is made to the following description and drawings, in which like reference numerals are used to refer to like elements, and wherein.

While the present invention will be described with a reference to preferred embodiments thereof, it will be understood that the invention is not to be limited to those preferred embodiments. On the contrary, it is intended that the present invention cover all alternatives, modifications, and equivalents as may be included within the spirit and scope of the invention as defined by the appended claims. Other aspects and features of the present invention will become apparent as the description proceeds.

DESCRIPTION OF EMBODIMENTS

It will become apparent from the following discussion that the stacking apparatus and method of the present invention is equally well suited for use in a wide variety of printing systems including electrophotographic or electronic printing systems, as for example, ink jet, bubble jet, ionographic, laser based exposure systems, etc. Further, the stacking apparatus and method of the present invention is equally well suited for use in any type of document handling system wherein documents having fasteners, staples or the like are stacked.

Figure 1:
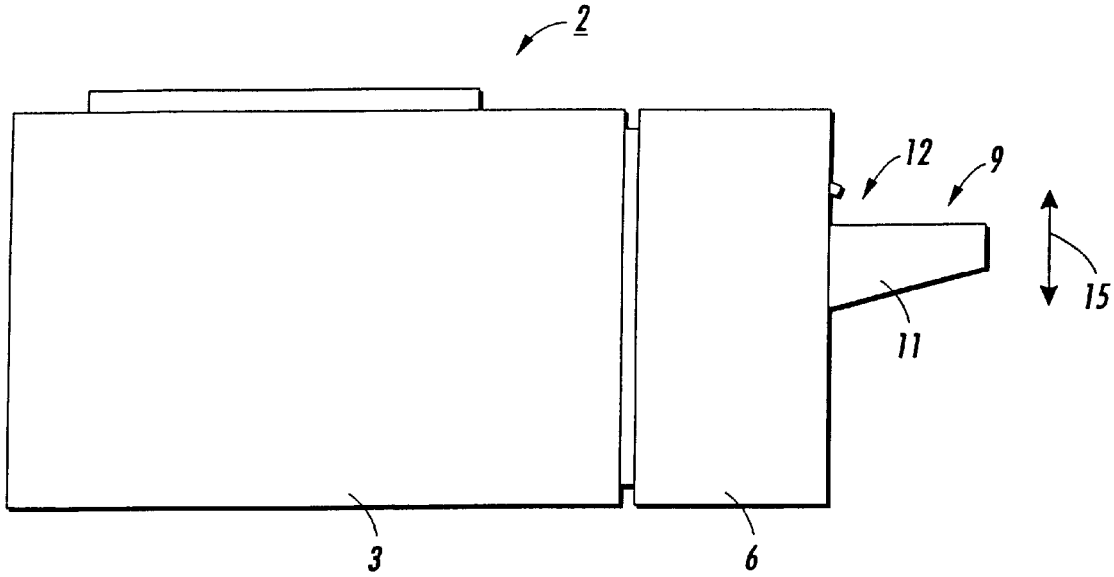
FIG. 1 is a schematic view of a copying system.

FIG. 1 shows one embodiment of the present invention. In FIG. 1 there is shown, in schematic form, a view of a copying system 2 for processing, printing and finishing document copying jobs in accordance with teachings of the present invention. A copying system of the type shown is preferably adapted to provide, in a known manner, duplex or simplex, stacked fastened, stapled or bound document sets from duplex or simplex collated document or print sets which result from either duplex or simplex original documents. Copying system 2 has any suitable processing or printing section 3, such as a xerographic processor, a finishing section 6 and an output section 9. The exemplary xerographic processing or printing section 3 is a generally well known type such as made by Xerox Corporation, such as Models "1075", "5090" or "5100" duplicators. Such electrostatographic printing systems are illustrated and described in detail in various patents including U.S. Pat. No. 4,961,092, the principal operation of which may also be disclosed in various other xerographic or other printing machines. U.S. Pat. No. 4,961,092 is incorporated by reference herein in its entirety. Finishing section 6 is a generally well known type and may incorporate a hole punch, a stapler and a bin sorter which are illustrated and described in detail in various patents including U.S. Pat. No. 3,467,371 and U.S. Pat. No. 5,842,624 and U.S. Pat. No. 5,762,329, all three of which are also incorporated herein by reference in their entirety. Output section 9 incorporates a tray 11 which accepts and stacks stapled or unstapled documents or document sets ejected from finishing section 6 at ejection zone 12. Tray 11 can be vertically movable in direction 15 in order to facilitate stacking of document sets.

Figure 2A:
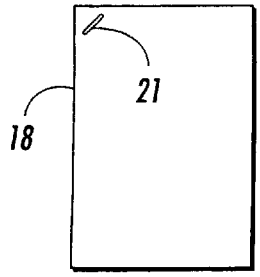
FIG. 2A PRIOR ART
FIG. 2A is a top view of a stapled document set with a single staple in a corner.
Figure 2B:
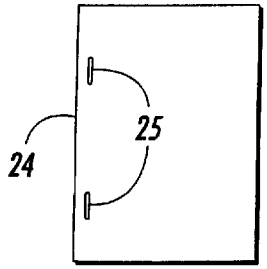
FIG. 2B PRIOR ART
FIG. 2B is a top view of a stapled document set with two staples along an edge.
Figure 2C:
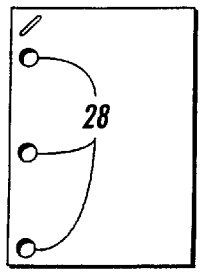
FIG. 2C PRIOR ART
FIG. 2C is a top view of a stapled document set with holes punched along an edge.
Figure 2D:
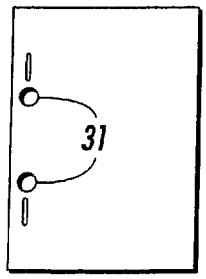
FIG. 2D PRIOR ART
FIG. 2D is a top view of an alternative stapled document set with holes punched along an edge.

In FIGS. 2A through 2D there is shown views of several representative styles of stapled document sets. In FIG. 2A there is shown a stapled document set 18 with a single staple 21 in a corner of stapled document set 18. In FIG. 2B there is shown a stapled document set 24 with a two staples 25 along an edge of stapled document set 24. In FIG. 2C there is shown the stapled document set of FIG. 2A with holes 28 punched along an edge. In FIG. 2D there is shown the stapled document set of FIG. 2B with holes 31 punched along an edge. The stapled document sets shown in FIGS. 2A through 2D are intended to be exemplary, and it will be understood that the stacking apparatus and method of the present invention is equally well suited and can be adapted for use with document sets with any one of a number of types of fasteners including but not limited to staples, clips or rivets or the like located at any of a number of varying locations or quantities on the document sets.

Figure 3A:
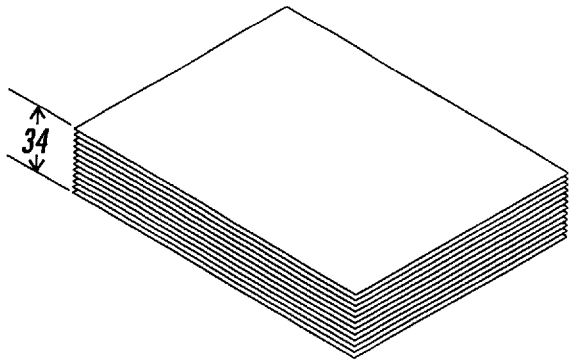
FIG. 3A PRIOR ART
FIG. 3A is a perspective view of a stack of document sets without fasteners.
Figure 3B:
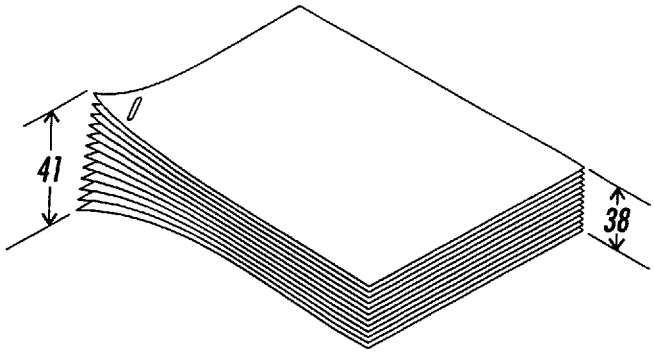
FIG. 3B PRIOR ART
FIG. 3B is a perspective view of a stack of document sets with a fastener in each set, such as shown in FIG. 2A, which shows the normal build up of thickness in the staple area.
Figure 3C:
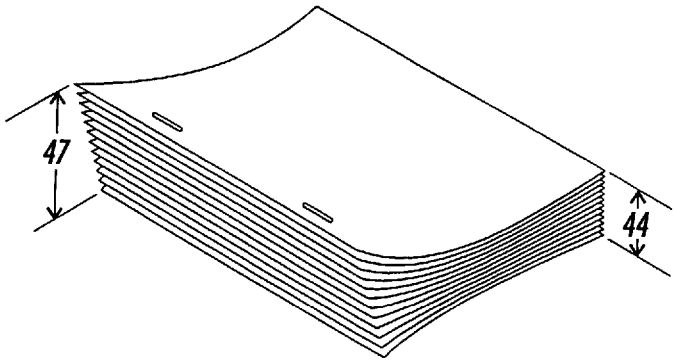
FIG. 3C PRIOR ART
FIG. 3C is a perspective view of an alternative stack of document sets with a fastener in each set, such as shown in FIG. 2B, which shows the normal build up of thickness along the stapled edge.

In FIGS. 3A through 3C show various orientations of stacked document sets. In FIG. 3A there is shown a stack of documents or document sets which do not have staples or fasteners. Note that thickness 34 of the stack is generally of uniform thickness across the stack. In FIG. 3B there is shown a stack of stapled document sets similar to that of FIG. 2A. Note that thickness 41 of the stack in proximity with the staples is greater than thickness 38 of the stack distant from the staples. In FIG. 3C there is shown a stack of stapled document sets similar to that of FIG. 2B. Note that thickness 47 of the stack in proximity with the staples is greater than thickness 44 of the stack distant from the staples.

Figure 4A:
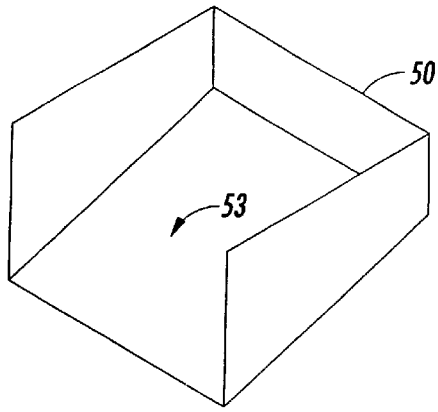
FIG. 4A PRIOR ART
FIG. 4A is a view of a document tray.

In FIG. 4A there is shown a view of a representative prior art document tray. In FIG. 4A there is shown tray 50 with stacking area 53. Tray 50 is suitable for stacking sets of documents or document sets which do or do not have staples or fasteners similar to that shown in FIG. 3A. However, when the sets have staples, the area of the stack in the region of the staples will be thicker than the rest of the stack, as shown in FIG. 3B, and this will limit the amount of sets that the tray can hold as opposed to when the sets are not stapled.

Figure 4B:
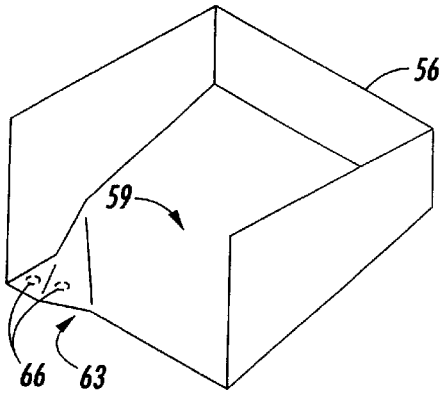
FIG. 4B is a view of a document tray with a relief area.

In FIG. 4B there is shown tray 56 with stacking area 59, relief area 63 and magnet 66. Tray 56 is suitable for stacking a stack of stapled document sets similar to that shown in FIG. 2A. Note that magnet 66 is placed in proximity to the corners of the document sets with the staples in order to attract the stapled corners into the relief area 63. Magnet 66 may be imbedded in tray 56, molded with tray 56, be mounted on a surface of tray 56 or otherwise be placed in proximity of tray 56 such that magnet 66 is placed in proximity to the corners of the document sets with the staples in order to attract the stapled corners into the relief area. As document sets are stacked in tray 56, magnet 66 attracts the staples or fasteners of the document sets such that relief area 63 accommodates the bulk produced by the stapled corner and the region of the document set associated with the stapled corner. The rest of the stack of document sets remains relatively flat similar to stacks of document sets that have no fasteners or staples. The result is that more document sets may be placed in tray 56. Further, as a result of the staples or fasteners being attracted to magnet 66 and as a result to each other, the retaining force generated provides a reduced tendency of the set being fed and stacked to be torn or otherwise damaged by the sets already in the stack or of the set being fed and stacked to tear or otherwise damage the top sheet of the top set of the sets already in the stack or to be torn or otherwise damaged by the sets already in the stack.

Figure 4C:
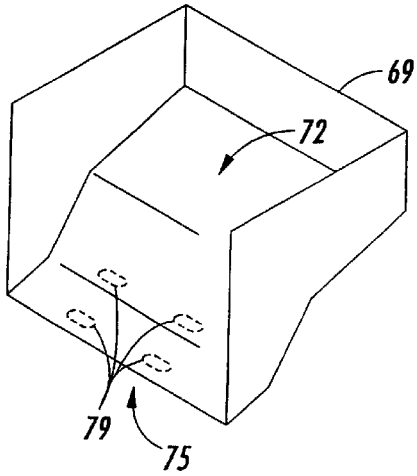
FIG. 4C is a view of an alternative document tray with a relief area.

In FIG. 4C there is shown tray 69 with stacking area 72, relief area 75 and magnet 79. Tray 69 is suitable for stacking stapled document sets similar to that shown in FIG. 2B. Note that magnet 79 is placed in proximity to the edge of the document sets with the staples in order to attract the stapled edges into the relief area. Magnet 79 may be imbedded in tray 69, molded with tray 69, be mounted on a surface of tray 69 or otherwise be placed in proximity of tray 69 such that magnet 79 is placed in proximity to the edge of the document sets with the staples in order to attract the stapled edge into the relief area. As document sets are stacked in tray 69, magnet 79 attracts the staples or fasteners of the document sets such that relief area 75 accommodates the bulk produced by the stapled edge and the region of the document set associated with the stapled edge. The rest of the stack of document sets remains relatively flat similar to stacks of document sets that have no fasteners or staples. The result is that more document sets may be placed in tray 69. Further, as a result of the staples or fasteners being attracted to magnet 79 and as a result to each other, the retaining force generated provides a reduced tendency of the set being fed and stacked to be torn or otherwise damaged by the sets already in the stack or of the set being fed and stacked to tear or otherwise damage the top sheet of the top set of the sets already in the stack or to be torn or otherwise damaged by the sets already in the stack.

Magnets 66 or 79 can be a single magnet or a plurality of magnets. Magnets 66 or 79 can be any suitable piece of iron, steel or other material that has the property of attracting the material of the fastener, for instance, iron, steel or other suitable fastener materials etc. The property that produces the force attracting the staples or fasteners may be naturally present or artificially induced, as by selectively passing an electric current through a coil of wire thus making a magnetic field with an electromagnet, or as by selectively canceling out the field produced by the magnet with an additional opposing naturally present or artificially induced magnetic field. When the field is selectively produced, the field may be switchable between a on-fastener attracting state and a off-fastener release state. This may be useful, for example, to facilitate higher capacity stacking and to further facilitate document set retention with the on-fastener attracting state and for ease of removal of the document sets with the off-fastener release state. Magnets 66 or 79 can be of any suitable shape for the function they provide, for instance, they can be generally cylindrical in shape but may be in the shape of a rectangle, disk, ring or any other suitable shape. Magnets 66 or 79 may be a permanent magnet of types known in the art. Magnets 66 or 79 may be made by any suitable material. For instance, they can be made of a Rare Earth, Neodymium-Iron-Boron magnet, ½" diameter, ½" length, model number RMND112 manufactured by the Rochester Magnet Company of Rochester, N.Y. Magnets 66 or 79 may be an electromagnet, or any type of magnet with fixed or switchable field. Magnets 66 or 79 may be a single magnet or multiple magnets. If magnets 66 or 79 are of the electromagnet type or a magnet of the type with a switchable field, the field may always be on, thus attracting the fasteners or staples and retaining the document sets. Alternately, the field may be on only during the stacking operation thus allowing ease of removal of the stack of stapled document sets when the field is off and not attracting the stapled document sets.

Figure 5A:
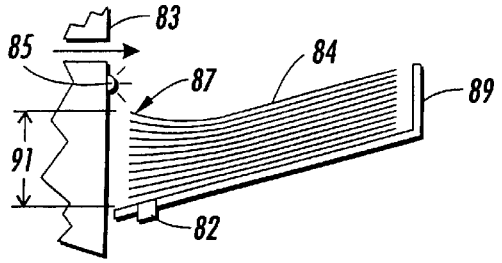
FIG. 5A is a side schematic view of a document tray with a stack of stapled document sets.
Figure 5B:
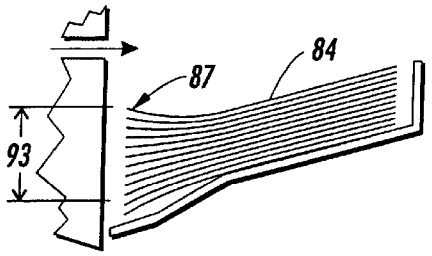
FIG. 5B PRIOR ART
FIG. 5B is a side schematic view of another document tray with a stack of stapled document sets.
Figure 5C:
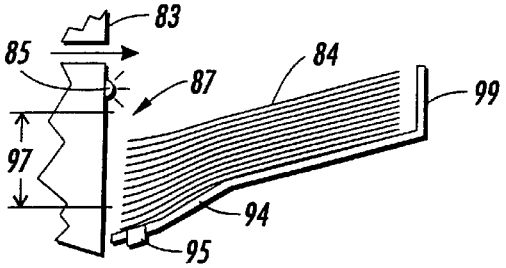
FIG. 5C is a side schematic view of still another document tray with a stack of stapled document sets.

FIGS. 5A through 5D show views of document trays with stacks of stapled document sets. In FIGS. 5A and 5C, magnets are placed in proximity to the fasteners or staples. As a result of the staples or fasteners being attracted to the magnet(s) and to each other, the retaining force generated provides a reduced tendency of the set being fed and stacked to be torn or otherwise damaged by the sets already in the stack or of the set being fed and stacked to tear or otherwise damage the top sheet of the top set of the sets already in the stack or to be torn or otherwise damaged by the sets already in the stack.

Also as a result of the staples or fasteners being attracted to the magnet(s) and to each other, the portion of the document sets containing the staples or fasteners are deflected toward the recess 94 of the document tray 99 as shown in FIG. 5C.

FIG. 5A shows a tray similar to that shown in FIG. 4A. In FIG. 5A there is a magnet 82 placed in proximity with stapled edge or stapled corner 87 of stapled document set stack 84. The height 91 of stapled document set stack 84 in proximity to stapled edge or stapled corner 87 is reduced as compared to if magnet 82 were not present. This allows for increased capacity of tray 89 as compared to a tray of similar size without magnet 82. Stapled documents can continue to be ejected from ejection zone 83 until stack height sensor 85 detects that tray 89 is at capacity, at which point the system can be shut off until the documents sets are removed. Stack height sensor 85 can read that tray 89 is at capacity with less stapled documents than when magnet 82 is not present. Stack height sensor 85 can read that tray 89 is at capacity with more stapled documents when magnet 82 is present.

FIG. 5B shows a tray similar to that shown in FIG. 4B or FIG. 4C without magnet 66 or 79. Height 93 of stapled document set stack 84 is greater than if a magnet were present to compress it. FIG. 5C has a magnet 95 placed in proximity with stapled edge or stapled corner 87 of stapled document set stack 84 allowing height 97 of stapled document set stack 84 in proximity to stapled edge or stapled corner 87 to be less than if magnet 95 were not present. Again, this allows stapled edge or stapled corner 87 of stapled document set stack 84 to be drawn into recess 94 and also allows for increased capacity of tray 99 as compared to a tray of similar size without magnet 95. Stapled documents can continue to be ejected from ejection zone 83 until stack height sensor 85 detects that tray 99 is at capacity. Stack height sensor 85 will read that tray 99 is at capacity with less stapled documents when magnet 95 is not present. Stack height sensor 85 can read that tray 99 is at capacity with more stapled documents when magnet 95 is present.

Figure 5D:
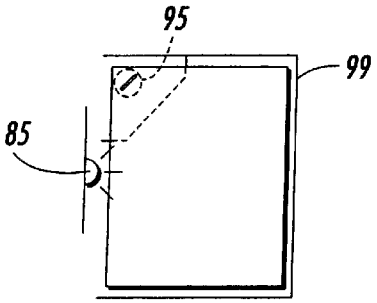
FIG. 5D is a top view of a document tray with a stack of stapled document sets.

FIG. 5D shows tray 99 in the configuration of the tray shown in FIG. 4B. The increased height of the stapled end of the stapled documents does not affect the height at which stack height sensor 85 detects that tray 99 is at capacity. If magnet 95 were not present in FIG. 5C, the increased height of the stapled end of the stapled documents would affect the height at which stack height sensor 85 detects that tray 99 is at capacity, resulting in reduced capacity of tray 99.

Figure 6:
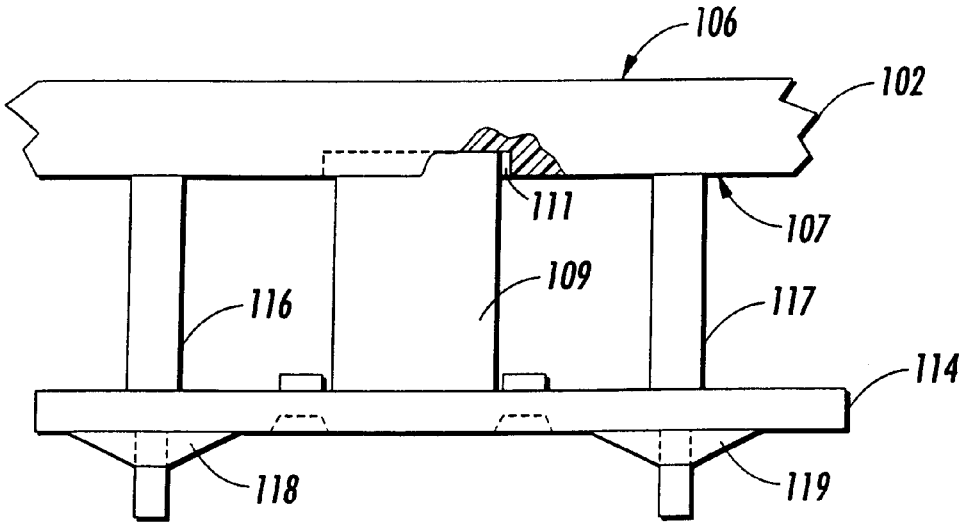
FIG. 6 is a view of a magnet mounted on a document tray.

FIG. 6 shows a detailed view of one embodiment of mounting a magnet on a document tray. Tray or relief area 102 has a document set side 106 and a magnet mounting underside 107. Magnet 109 is retained in tray recess 111 with magnet retaining plate 114. Posts 116 and 117 are molded or fabricated as part of tray or relief area 102. Posts 116 and 117 are sized to accept magnet retaining plate 114 and snap washers 118 and 119. Magnet retaining plate 114 is held in place relative to tray or relief area 102 with snap washers 118 and 119.

Figure 7:
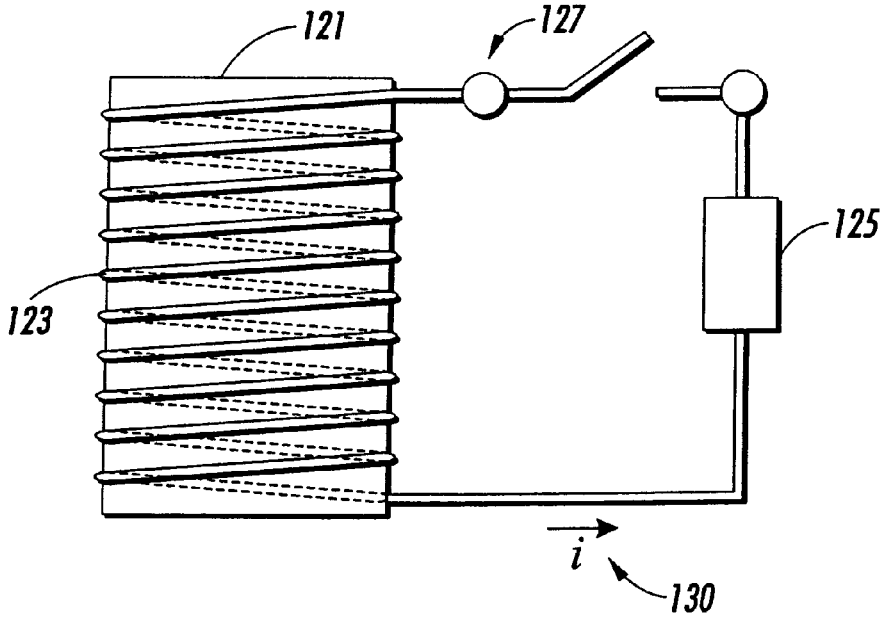
FIG. 7 is a view of a electromagnet.

FIG. 7 shows a view of a electromagnet where the property that produces the force attracting the staples or fasteners is artificially induced. Electric current 130 is produced by power source 125 when switch 127 is closed. Electric current 130 passes through coil of wire 123 that incduces a magnetic field in core 121. The magnetic field is selectively produced by changing the state of switch 127 either manually or automatically as with a controller. The field may be switchable between a on-fastener attracting state and a off-fastener release state. This may be useful, for example, to facilitate higher capacity stacking and to further facilitate document set retention with the on-fastener attracting state and for ease of removal of the document sets with the off-fastener release state.

It should be understood that the foregoing description is only illustrative of the invention. Various alternatives and modifications can be devised by those skilled in the art without departing from the invention. Such alternatives may include substituting any suitable materials for the magnets or fasteners herein described. Such alternatives may further include configuring the magnets or fasteners in any suitable manner. Such alternatives may further include configuring the magnets or fasteners in an alternative system or subsystem of a copier, printer or paper or document set handling apparatus. Accordingly, the present invention is intended to embrace all such alternatives, modifications and variances which fall within the scope of the appended claims.

What is claimed is:

1. A document set stacking apparatus comprising:

a set stacking area adapted to accept a stack of document sets having fasteners positioned so as not to extend beyond edges of the document set;

a set relief area toward which a portion of the document set containing the fastener can be attracted; and a fastener located in the set relief area;

wherein, the fastener attractor attracts the portion of the document set containing the fastener toward the set relief area and deflects the portion of the document set toward the set relief area.

2. The document set stacking apparatus of claim 1 wherein the fastener attractor is a magnet.

3. The document set stacking apparatus of claim 1 wherein the fasteners are staples.

4. A document creating apparatus comprising:

the document set stacking apparatus of claim 1;

a copying or printing apparatus adapted to copy or print document sheets; and a finishing section adapted to accept document sheets from the copying or printing apparatus, the finishing section further adapted to sort document sheets to form document sets, and the finishing section further adapted to fasten document sets with fasteners;

wherein the finishing section supplies document sets having fasteners to the set stacking area of the document set stacking apparatus.

5. The document creating apparatus of claim 4 further comprising:

a stapler;

wherein, the fasteners comprise staples; and wherein the stapler fastens document sets.

6. The document set stacking apparatus of claim 2 wherein the magnet comprises a permanent magnet.

7. The document set stacking apparatus of claim 2 wherein the magnet comprises a electro magnet.

8. The document set stacking apparatus of claim 7 wherein the electro magnet is switchable between an on-fastener attracting state and an off-fastener release state.

9. The document set stacking apparatus of claim 1 wherein the set stacking area is movable.

10. The document set stacking apparatus of claim 1 wherein the set stacking area is vertically movable.

11. The document set stacking apparatus of claim 2 further comprising a magnet retaining plate; wherein, the magnet retaining plate retains the at least one magnet adjacent to the set relief area.

12. A document set stacking apparatus comprising:

a tray onto which a plurality of document sets having fasteners positioned so as not to extend beyond edges of the document set can be placed in a stack; and a magnetic device located in a set relief area of the tray adapted to attract the fasteners;

wherein, the fasteners are attracted to the magnetic device; and wherein, the document sets are, at least partially, retained in the stack by the magnetic device for allowing a new document set to be fed to the stack.

13. The document set stacking apparatus of claim 12 wherein the fasteners are staples.

14. A document creating apparatus comprising:

the document set stacking apparatus of claim 12;

a copying or printing apparatus adapted to copy or print document sheets; and a finishing section adapted to accept document sheets from the copying or printing apparatus, the finishing section further adapted to sort document sheets to form document sets, and the finishing section further adapted to fasten document sets with fasteners;

wherein the finishing section supplies document sets having fasteners to the set stacking area of the document set stacking apparatus.

15. The document creating apparatus of claim 14 further comprising:

a stapler;

wherein, the fasteners comprise staples; and wherein the stapler fastens document sets.

16. The document set stacking apparatus of claim 12 wherein the magnetic device comprises a permanent magnet.

17. The document set stacking apparatus of claim 12 wherein the magnet comprises a electro magnet.

18. The document set stacking apparatus of claim 17 wherein the electro magnet is switchable between an on-fastener attracting state and an off-fastener release state.

19. The document set stacking apparatus of claim 12 wherein the tray is movable.

20. The stapled document set stacking apparatus of claim 12 further comprising a magnet retaining plate; wherein, the magnet retaining plate retains the at least one magnet.

21. A method of stacking one or more document sets on a stacking surface comprising:

fastening each document set with a fastener positioned so as not to extend beyond edges of the document set;

placing at least one document set on the stacking surface; and attracting, with an attractor, the fastener as well as the region of the set containing the fastener toward a set relief area of the stacking surface; wherein the attractor is located in the set relief area, and wherein attraction by the attractor deflects the region of the set toward the set relief area.

22. The method of claim 21 wherein a magnetic force attracts the fastener toward the relief area.

23. The method of claim 21 wherein the step of placing includes ejecting the set from a copier or printer.

* * * * *